US006421887B1

(12) United States Patent
Oda et al.

(10) Patent No.: US 6,421,887 B1
(45) Date of Patent: Jul. 23, 2002

(54) BOTTOM END STOP FOR SLIDE FASTENER

(75) Inventors: Kiyoshi Oda; Koji Yamagishi, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/502,705

(22) Filed: Feb. 11, 2000

(30) Foreign Application Priority Data

Feb. 15, 1999 (JP) ..... 11-035982

(51) Int. Cl.[7] ..... A44B 1/04
(52) U.S. Cl. ..... 24/433
(58) Field of Search ..... 24/388, 433–436

(56) References Cited

U.S. PATENT DOCUMENTS

| | | | | |
|---|---|---|---|---|
| 1,704,579 | A | * | 3/1929 | Sanford |
| 2,203,005 | A | * | 6/1940 | Wittenberg et al. |
| 3,004,318 | A | * | 10/1961 | Weiser |
| 4,139,927 | A | * | 2/1979 | Heimberger |
| 4,232,429 | A | * | 11/1980 | Friedberg |
| 4,232,430 | A | * | 11/1980 | Friedberg |
| RE31,487 | E | * | 1/1984 | Friedberg |
| 5,333,362 | A | * | 8/1994 | Gillioz |
| 5,396,685 | A | * | 3/1995 | Wilk |
| 6,088,888 | A | * | 7/2000 | Oda |

FOREIGN PATENT DOCUMENTS

| | | | |
|---|---|---|---|
| FR | 38450 | * | 6/1931 |
| GB | 363596 | * | 12/1931 |

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

This invention provides a bottom end stop for a slide fastener in which an engaging/disengaging operation can be achieved easily and quickly without an interruption by a slider pull tab while engaging/disengaging the bottom end stop. A joining piece is attached to the bottom of one stringer and a fitting piece is attached to the bottom of the other stringer. The joining piece includes a holding portion that includes an insertion concave groove, a base portion formed on the holding portion, and a male engaging portion comprising a pair of elastically deformable leg portions provided on the base portion. The fitting piece includes a insertion portion which can be fit into the insertion concave groove of the joining piece, a base portion provided on the insertion portion, and a female engaging portion comprising a hole portion, in which the leg portions of the male engaging portion can be fit, provided on the base portion of the fitting piece. In operation, the slider is inserted into the holding portion to engage the female and male engaging portions. Then, the insertion portion is rotated and fit into the insertion concave groove so that the slider can slide. Since the female and male engaging portions are engaged on an opposite surface to a side in which a single pull tab of the slider exists, even when the pull tab of the slider hangs downward, the engaging operation between the female and male engaging portions is never obstructed.

8 Claims, 13 Drawing Sheets

BOTTOM END STOP FOR SLIDE FASTENER

BACKGROUND OF THE INVENTION

1. Field of the Invention

The present invention relates to a bottom end stop for a slide fastener. The bottom end stop for a slide fastener attached to bottom ends of the fastener stringers comprises a fitting piece on one side and a joining piece on the other. The fitting piece and the joining piece are engaged with each other vertically with respect to a fastener face, that is, in a front-rear surface direction by a snap method and then the fitting piece and joining piece are joined together in a lateral direction of the fastener, so that the fastener stringers can be fit and attached into the slider.

2. Description of the Related Art

A conventional type of bottom end stop for a slide fastener, in which a fastener stringer is fit laterally into the slider is disclosed in the specification of the U.S. Pat. No. 4,139,927. As shown in FIG. 18, a fitting piece 11' and a joining piece 10' attached to bottom ends of the right and left fastener stringers 1' are formed of a pin 50' having an expanding head portion provided at a front end thereof and a socket 51' in which a protruding portion is formed on an inner face of a circular hole portion. After the pin 50' and the socket 51' are engaged with each other by a snap method, a blade 52' formed on one fastener stringer 1' is fit in between guide flanges of the slider 3' provided on the other fastener stringer 1' by rotating around the pin 50' and the socket 51'.

In the bottom end stop for a slide fastener of a type in which one of fastener stringers 1' is fit laterally into the slider 3' provided on the other fastener stringer 1' as described above, the pin 50' for engaging the fitting piece 11' with the joining piece 10' is provided so as to protrude toward a surface of the fastener stringer 1' and then engaged with the socket 51'. However, since the slider 3' is provided on the fastener stringer 1' of the pin side, each time an operation for engaging the pin 50' with the socket 51' is carried out, a hanging pull tab has to be raised upward of the fastener chain. Thus, the releasing operation is very troublesome and therefore, cannot be carried out quickly.

The present invention has been achieved in views of the above described problem. An object of the present invention is to provide a bottom end stop for a slide fastener, wherein a fitting piece having a female engaging portion is attached to one of right and left fastener stringers and a joining piece having a male engaging portion is attached to the other fastener stringer, while the female engaging portion and the male engaging portion are capable of engaging with/disengaging from each other in a vertical direction with respect to the fastener faces and rotating in a horizontal direction when they are engaged with each other. The slider is held by a holding portion provided on one of the male and female engaging portions to prevent the slider from dropping out, and the male engaging portion is engaged with the female engaging portion on an opposite surface to a surface in which a single pull tab provided on the slider exists, thereby preventing the pull tab provided on the slider from obstructing an engaging operation between the male engaging portion and the female engaging portion, so that the engaging/disengaging operation can be carried out easily and quickly.

Another object of the present invention is to provide a bottom end stop for a slide fastener in which a male engaging portion thereof is composed of a pair of leg portions which is circular in its outer shape and easily deformed elastically facing in a longitudinal direction of the fastener tape. A female engaging portion is formed to have locking portions to easily lock with the leg portions, provided on an inner face of a circular hole portion. Even if a lateral pulling force is applied to a fastener chain, particularly to the bottom end stop from the right and left directions, the engagement between the male engaging portion and the female engaging portion is never released.

Still another object of the present invention is to provide a bottom end stop for a slide fastener in which the male engaging portion comprises a thick portion around the periphery of a base portion thereof and a protrusion having expanding head portions provided at a tip thereof. The female engaging portion is provided with elastic pieces easily deformed elastically and capable of engaging with the protrusion formed on an inner face of the hole portion in which the protrusion can be inserted and is formed so that the thick portion comes adjacent to the inner peripheral surface of the hole portion. Even when a lateral pulling force is applied to a fastener chain, particularly to the bottom end stop from the right and left directions, the engagement is never released.

It is an object of the present invention to provide a bottom end stop for a slide fastener in which the protrusion is provided with head portions expanding outward on opposing faces and the inner face of the hole portion is provided with the protruding portion which lie over each of the head portions when the fitting piece and joining piece are rotated in a direction that they are joined together. Even when a pushing-up force is applied to a fastener chain, particularly to the bottom end stop from the front or back surface thereof, the engagement is never released.

It is another object of the present invention to provide a bottom end stop for a slide fastener in which the joining piece is provided with a convex portion protruded horizontally and a concave portion in which the convex portion can be fit when the fitting piece and joining piece are rotated in a direction that they are joined together. Even when a pushing-up force is applied to the bottom end stop from the front or back surface thereof, the engagement is never released.

Another object of the present invention is to provide a bottom end stop for a slide fastener in which the concave portion comprises an inner surface on a base portion of a side in which the fitting piece and joining piece lie over each other, a vertical wall erected on this base portion and a horizontal plate extending from a tip of the vertical wall in parallel to the inner surface of the base portion. This restricts easily a position in which the convex portion is inserted into the concave portion and enables to specify an engagement position between the fitting piece and joining piece easily.

Still another object of the present invention is to provide a bottom end stop for a slide fastener in which when the fitting piece and joining piece are engaged with each other and rotated in a direction that they are joined together, the slider provided on the fastener stringer is moved slightly upward of the fastener chain, thereby starting operation of the slider can be carried out securely and easily.

It is an object of the present invention to provide a bottom end stop for a slide fastener in which the female engaging portion and male engaging portion are disposed outside of an end portion of the fastener tape, a rotation of the right and left fastener stringers is facilitated and the female engaging portion and male engaging portion are formed in a rigid structure.

To achieve the above described objects, according to the first aspect of the invention, there is provided a bottom end stop for a slide fastener, wherein a fitting piece 11 is attached to a bottom end of one of right and left fastener stringers 1 of the slide fastener while a joining piece 10 is attached to the bottom end of the other, a female engaging portion 34 and a male engaging portion 20 are formed on the fitting piece 11 and the joining piece 10 respectively, such that they can be engaged with/disengaged from each other in a vertical direction with respect to faces of respective fastener tapes 2 and so that the female engaging portion 34 and the male engaging portion 20 are rotatable in a horizontal direction when they engage each other by a snap method, a protruded holding portion 13 is provided for preventing an escape of a slider 3 on the joining piece 10 or the fitting piece 11 on an opposing edge portion of the fastener stringer 1; the joining piece 10 or the fitting piece 11 in which the slider 3 is fit and held in the holding portion 13 thereof faces the fitting piece 11 or the joining piece 10 on an opposite surface to a surface in which a single pull tab 5 of the slider 3 exists, so that the male engaging portion 20 and the female engaging portion 34 can engage each other.

Preferably, there is provided a bottom end stop for a slide fastener, wherein the male engaging portion 20 provided on the joining piece 10 has leg portions 21 each having an outer face curved in an arc-shape and elastically deformable, and head portions 22 which are provided at a front ends of the leg portions 21 and expanding outward, the leg portions 21 being erected in a vertical direction with respect to the faces of fastener tapes 2 while facing in a longitudinal direction in form of a pair of projecting pieces, and the female engaging portion 34 provided on the fitting piece 11 has a circular hole portion 35 which is capable of inserting the leg portions 21 in a vertical direction with respect to the faces of the fastener tapes 2 so as to penetrate through the female engaging portion 34 and locking portions 36 which are protruded in the inner face of the hole portion 35 so that they are capable of locking with the head portions 22.

Further preferably, there is provided a bottom end stop for a slide fastener, wherein the male engaging portion 20 provided on the joining piece 10 has a thick portion 46 expanding around a periphery of a base portion thereof and head portions 45 provided at a front end thereof so that they expand outward, and a protrusion 44 erected vertically with respect to the faces of the fastener tapes 2 and the female engaging portion 34 provided on the fitting piece 11 has a circular hole portion 35 which is provided to penetrate through the female engaging portion 34 in a vertical direction with respect to the faces of the fastener tapes 2 and which is capable of inserting the protrusion 44, and elastic pieces 48 extending so as to project downward into the inner face of the hole portion 35 and which are capable of engaging the head portion 45, so that the thick portion 46 is capable of coming into contact with an inner face of the hole portion 35 when the head portions 45 engage with the elastic pieces 48.

Still preferably, there is provided a bottom end stop for a slide fastener, wherein the protrusion 44 provided on the male engaging portion 20 has the head portions 45 expanding to both sides so that they oppose each other and an inner face of the hole portion 35 provided in the female engaging portion 34 has protruding portions 47 which are provided so as to oppose each other and protrude inward and lies over the head portions 45 in a vertical direction with respect to the faces of the fastener tapes 2 when the fitting piece 11 and the joining piece 10 are rotated in a direction that they are joined together.

Preferably, there is provided a bottom end stop for a slide fastener, wherein each of the fitting piece 11 and the joining piece 10 have convex portions 23, 37 expanding in a horizontal direction with respect to the faces of fastener tapes 2 and concave portions 27, 40 capable of inserting the convex portions 23, 37 when the fitting piece 11 and the joining piece 10 are rotated in a direction that they are joined together.

Further preferably, there is provided a bottom end stop for a slide fastener, wherein the concave portions 27, 40 comprise inner surfaces 18 of a base portions 17 on a side in which the fitting piece 11 and the joining piece 10 lie over each other, vertical walls 25, 38 erected on the base portions 17 in a vertical direction with respect to the faces of fastener tapes 2, and horizontal plates 26, 39 provided at each end of the vertical walls 25, 38 and extending in parallel to the inner surface 18 of the base portion 17, the horizontal plates 26, 39 restricting a path of insertion of the convex portions 23, 37 into the concave portions 27, 40 when the fitting piece 11 engages the joining piece 10, thereby specifying an engagement position in the horizontal direction of the fitting piece 11 and joining piece 10.

Still preferably, there is provided a bottom end stop for a slide fastener, wherein a notch portion 14 of which the edge is gently inclined inwardly and which is capable of inserting a guide post 6 of the slider 3 is provided at a top portion of an outer edge of the holding portion 13 formed on one of the fitting piece 11 and the joining piece 10, and an insertion concave groove 15 is provided on a side edge face of the holding portion 13 while a flat insertion portion 30 capable of fitting into the insertion concave groove 15 is provided on the other one of the fitting piece 11 and the joining piece 10, so that when the insertion portion 30 is fit into the insertion concave groove 15 of the holding portion 13, the slider 3 fit into and held by the holding portion 13 is capable of moving slightly upward.

Finally, there is provided a bottom end stop for a slide fastener, wherein the female engaging portion 34 and male engaging portion 20 disposed on the fitting piece 11 and joining piece 10 attached to bottom ends of the fastener tapes 2 of the right and left fastener stringers 1 are located outside of the bottom ends of the fastener tapes 2.

DESCRIPTION OF THE PREFERRED EMBODIMENTS

Figure 1:
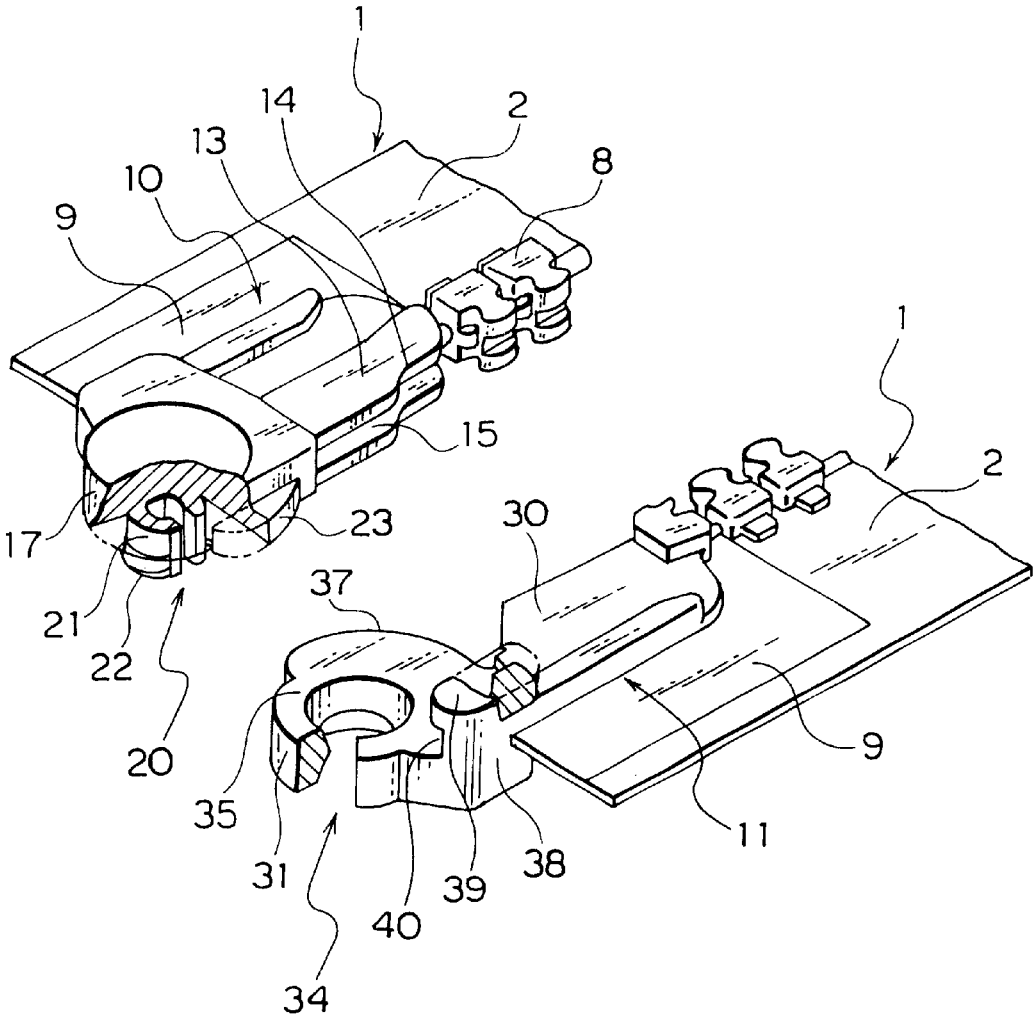
FIG. 1 is a perspective view showing a separation of a joining piece and a fitting piece of a bottom end stop according to a first embodiment of the invention.

Hereinafter, the embodiments of the bottom end stop for a slide fastener according to the present invention will be described in detail with reference to the accompanying drawings.

In the bottom end stop for a slide fastener of the present invention, a fitting piece 11 is attached to a bottom end of one of right and left fastener stringers 1 and a joining piece 10 is attached to a bottom end of the other fastener stringer 1. The fitting piece 11 and the joining piece 10 are formed by integral molding with injection molding means or extrusion means using thermoplastic resin such as polyamide, polyacetal, and polypropylene.

When attaching the joining piece 10 to the bottom end of one of the fastener stringers 1 in the bottom end stop of the first embodiment shown in FIGS. 1 to 6, a reinforcement tape 9 made of thermoplastic resin film is bonded to an end portion of a fastener tape 2 by pressure so as to reinforce the fastener tape 2. The joining piece 10 is molded integrally on the surface of the reinforcement tape 9.

The joining piece 10 has a holding portion 13 which is continuous with the fastener elements 8 mounted on the fastener tape 2, has the same thickness as a fastener element 8, is capable of fitting and holding the slider 3, and is protruded on both sides of the fastener tape 2. An end portion of an inner edge of this holding portion 13 is formed slightly in a V shape so as to guide a guide flanges 7 of the slider 3. A notch portion 14 which is inclined gently and which is smaller than an outer shape of a guide post 6 of the slider 3 and in which is capable of inserting the guide post 6 is formed on a top portion of an outer side edge opposing the other fastener stringer 1. An insertion concave groove 15 is formed on a side face of the outer side edge of the holding portion 13 so that an insertion portion 30 of the fitting piece 11 can be fit into.

Figure 5:
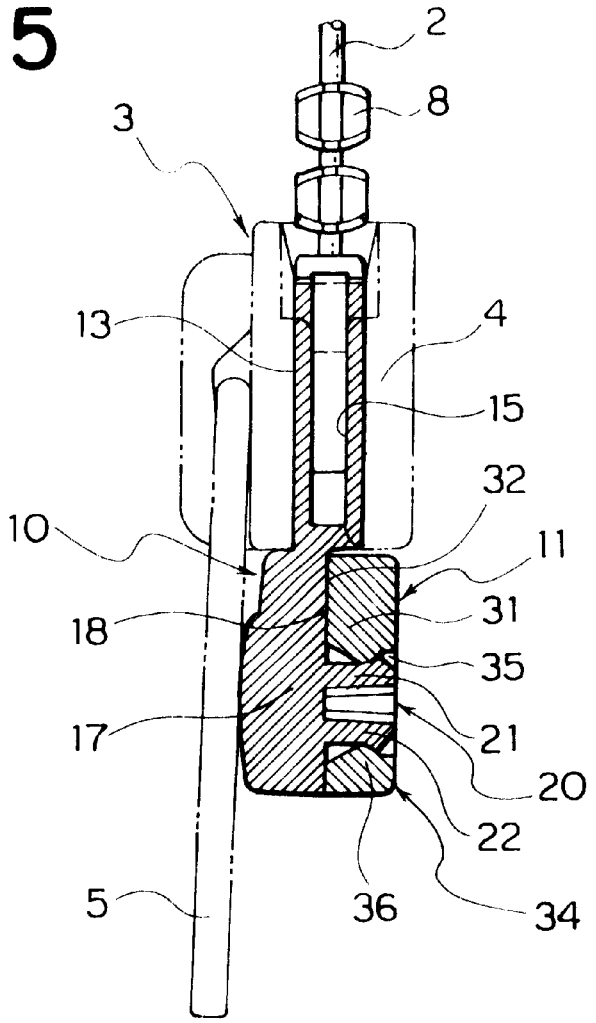
FIG. 5 is a sectional view of the bottom end stop taken along the line A—A of FIG. 2.

The holding portion 13 has a base portion 17 having substantially the same thickness as half the thickness of a body 4 of the slider 3 at a front end thereof as shown in FIG. 5. A male engaging portion 20 is protruded on an extension of the holding portion 13 on an inner surface 18 of the base portion 17, that is, a surface which is in contact with the base portion 31 of the engaging piece 11. The male engaging portion 20 has a pair of leg portions 21 which oppose each other in a longitudinal direction of the fastener stringer 1 and is easily deformed elastically. An outer face of the leg portion 21 is formed to be curved in an arc-shape. A head portion 22 is formed on an end portion of the leg portion 21 so that it expands outward. The pair of the leg portions 21 can be deformed elastically in a direction that they face each other, that is, such that respective head portions 22 approach each other in the longitudinal direction of the fastener stringer 1. As a result, even when a pulling-force to the right or left perpendicular to the longitudinal direction of the fastener stringer 1 is applied to the leg portions 21, the leg portions 21 are not deformed elastically so that an engagement between the male engaging portion 20 and female engaging portion 34 is never released.

Figure 6:
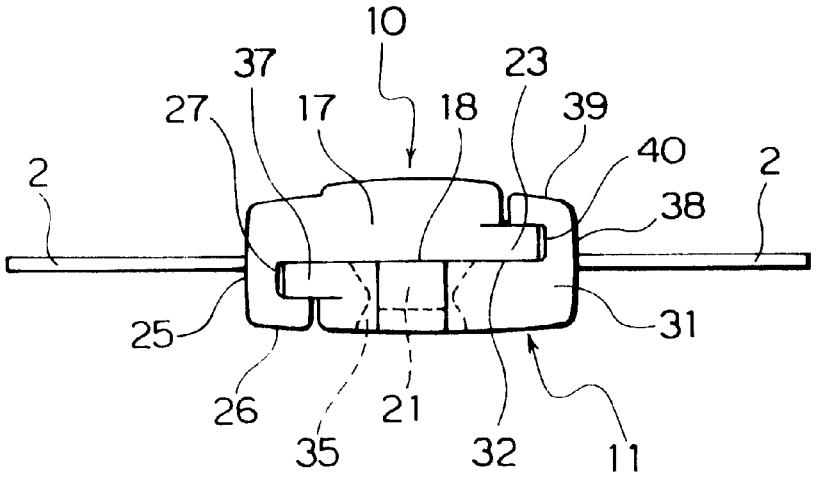
FIG. 6 is a bottom view of FIG. 4 of the bottom end stop.

A tongue-like convex portion 23 having a plane continuous with the inner surface 18 and protruded horizontally as shown in FIG. 6 is provided on an outer side face of the base portion 17, that is, a side face at a side opposing the other fastener stringer 1, so that it can fit into the concave portion 40 of the fitting piece 11. Further, a vertical wall 25 protruding from the inner surface 18 of the base portion 17 to a downward face, that is, to the rear side is provided so as to protrude on an inner side edge of the base portion 17, that is, an opposite side to the side in which the convex portion 23 is protruded. A horizontal plate 26 extending horizontally with respect to the inner surface 18 is formed at a front end of this vertical wall 25, and a concave portion 27 in which the convex portion 37 of the fitting piece 11 can fit is formed between the inner surface 18 of the base portion 17 and the horizontal plate 26. A protruded reinforcement rib 28 extending in parallel in the longitudinal direction of the fastener stringer 1 is provided with an interval with the holding portion 13 on an inner side edge of the joining piece 10, that is, an opposite side to the side in which the holding portion 13 is formed so as to reinforce the joining piece 10.

The fitting piece 11 corresponding to the joining piece 10 is attached to an lower end of the other fastener stringer 1. This fitting piece 11 is also molded integrally on the surface of the reinforcement tape 9 which reinforces the fastener tape 2.

As evident from FIG. 1, a flat, thin insertion portion 30 is formed continuously with the fastener element 8 located at a final end, the insertion portion 30 being capable of fitting into the insertion concave groove 15 provided in the holding portion 13. As shown in FIGS. 5 and 6, a base portion 31 having substantially the same thickness as the base portion 17 of the joining piece 10 is provided at a front end of this insertion portion 30. A female engaging portion 34 composed of a circular hole portion 35 in which the male engaging portion 20 protruded on the joining piece 10 substantially on an extension of a row of the fastener elements 8 is capable of fitting, is provided on an inner surface 32 of the base portion 31 which faces and overlies the inner surface 18 of the joining piece 10. As shown in FIG. 5, a locking portion 36 is formed around the center of the inner face of the hole portion 35 of this female engaging portion 34 such that it protrudes inward in the shape of a mountain, so that it can lock with the head portion 22 of the male engaging portion 20.

Similar to the joining piece 10, the fitting piece 11 is provided with a tongue-like convex portion 37 having a plane continuous with the inner surface 32 and extending horizontally on an outer side edge of the base portion 31, that is, a side face facing the other fastener stringer 1 as shown in FIG. 6, so that it fits in the concave portion 27 of the joining piece 10. A vertical wall 38 protruding from the inner surface 32 to a top face, that is, to the surface, is provided on an inner side edge of the base 31, that is, on an opposite side to the side in which the convex portion 37 is protruded. Further, a horizontal plate 39 extending horizontally is formed at an end of this vertical wall 38 such that it faces the inner surface 32, and a concave portion 40 in which the convex portion 23 of the joining piece 10 can fit into is formed between the inner surface 32 of the base portion 31 and the horizontal plate 39. A protruded reinforcement rib 41 extending in the longitudinal direction of the fastener stringer 1 is provided on an inner side edge of the fitting piece 11, that is, an opposite side to the side on which the insertion portion 30 is formed. Further, a coupling portion 42 whose one face has the same shape and thickness as the fastener element 8 is formed at a top portion of the outer side edge as shown in FIG. 1.

Figure 2:
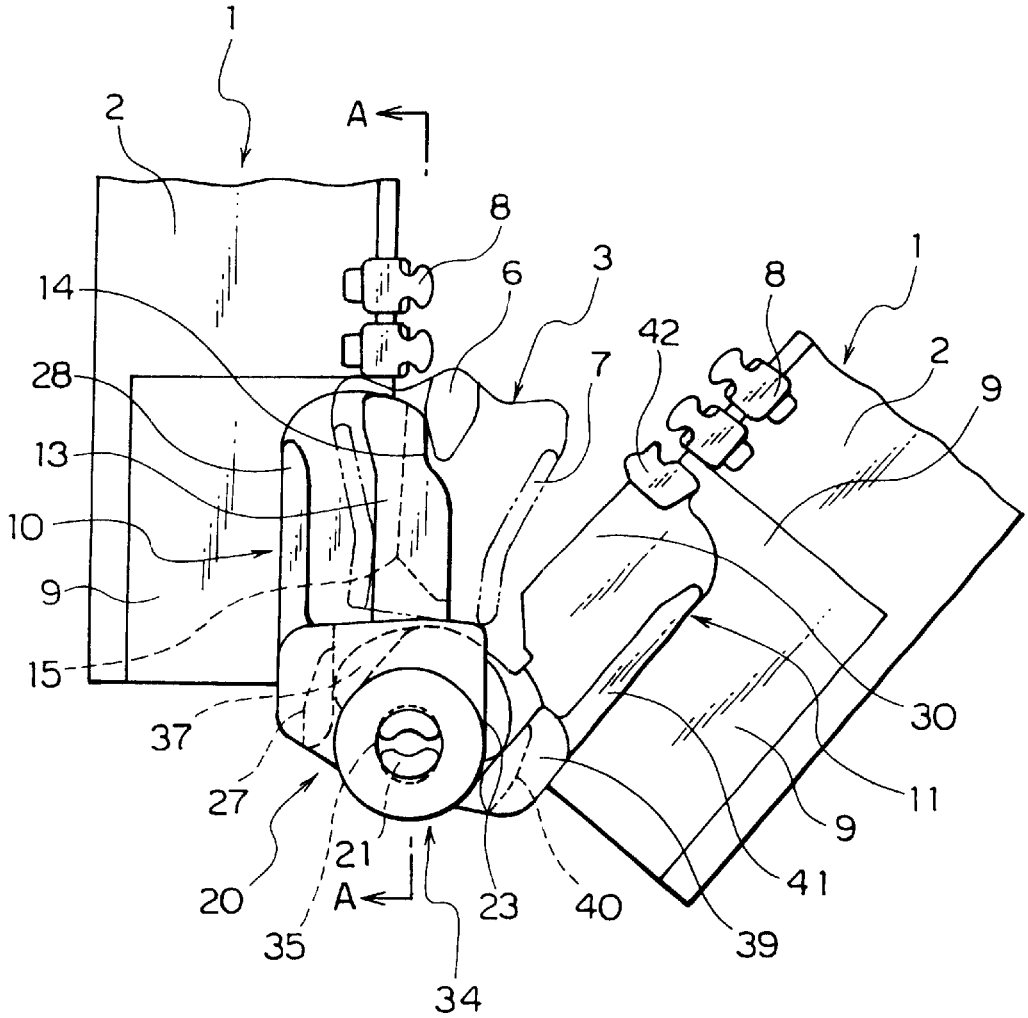
FIG. 2 is a front view showing a state of engagement between the joining piece and the fitting piece of the bottom end stop.

Next, an operation of the bottom end stop of the first embodiment will be described. As shown in FIG. 1, the male engaging portion 20 of the joining piece 10 attached to the bottom end of one of the fastener stringers 1 is brought into contact and pressed with the female engaging portion 34 of the fitting piece 11 attached to the bottom end of the other fastener stringer 1 so that they engage each other. At this time, the joining piece 10 and the fitting piece 11 are engaged such that the slider 3 is fit and held in the holding portion 13 of the joining piece 10, for example, in a state shown in FIG. 2. Upon engaging, the joining piece 10 and the fitting piece 11 are brought near each other in a vertical direction with respect to front and rear surfaces of the fastener tape 2 such that the convex portions 23, 37 do not come into contact with the horizontal plates 26, 39 forming the concave portions 27, 40. The leg portion 21 of the male engaging portion 20 is pressed by the hole portion 35 of the female engaging portion 34 and elastically deformed so that the leg portion 21 fits in the hole portion 35. As a result, the locking portion 36 of the hole portion 35 engages the head portion 22 of the leg portion 21 firmly. A separation angle between the joining piece 10 and the fitting piece 11 when they engage each other is determined by an existence of the convex portions 23, 37 and the horizontal plates 26, 39. As indicated by FIG. 2, the fitting piece 11 is engaged with the joining piece 10 at a predetermined separation angle such that the insertion portion 30 is located outside of the flange 7 of the slider 3. As a result, it is not necessary to keep eyes on the engagement of the joining piece 10 and the fitting piece 11 so that the flange 7 of the slider 3 does not collide with the insertion portion 30 of the fitting piece 11. This will enable the joining piece 10 and the fitting piece 11 to engage without any trouble.

In this case, the male engaging portion 20 of the joining piece 10 protrudes to the rear side of the bottom end stop so that it engages with the female engaging portion 34 of the fitting piece 11 on the rear side of the bottom end stop. Therefore, a pull tab 5 of the slider 3 is located on a front surface of the bottom end stop, that is, on an opposite side to which the inner surface 18 of the joining piece 10 faces the inner surface 32 of the fitting piece 11, with the base portion 17 of the joining piece 10 in between. Therefore, there is no trouble in the engaging operation of the male engaging portion 20 with the female engaging portion 34.

Figure 3:
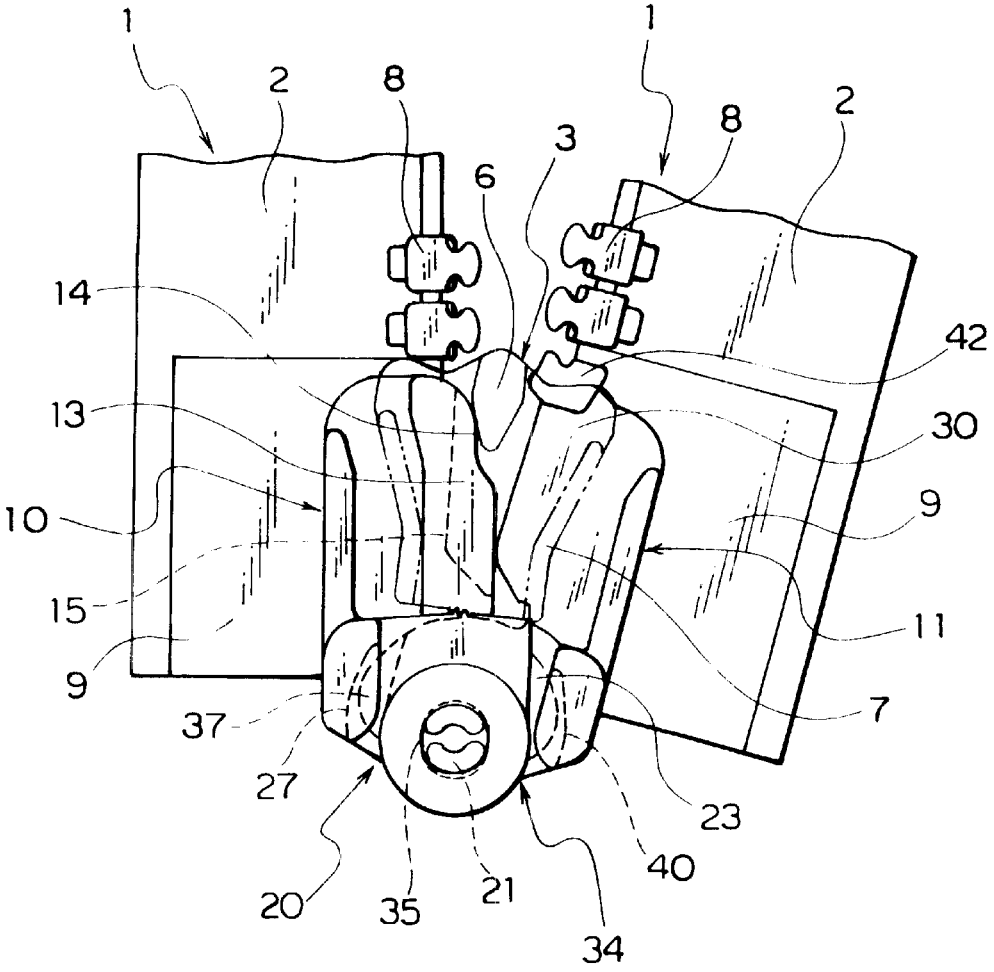
FIG. 3 is a front view of the bottom end stop when the joining piece and the fitting piece are rotated.
Figure 4:
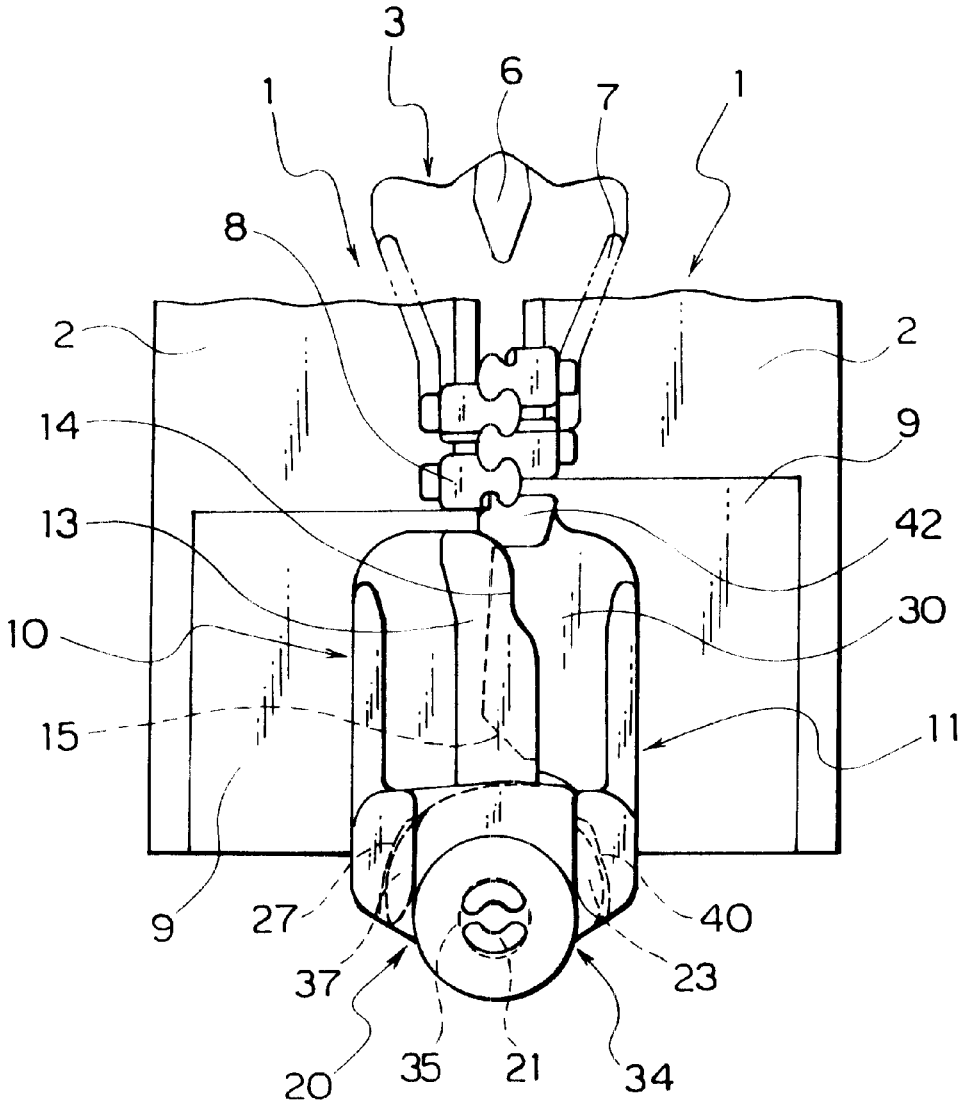
FIG. 4 is a front view of the bottom end stop when the joining piece and the fitting piece are joined together and a slider is started.

When the fitting piece 11 is rotated toward the joining piece 10 after the male engaging portion 20 is engaged with the female engaging portion 34, the insertion portion 30 of the fitting piece 11 is inserted into the slider 3 between the guide flanges 7 of the slider 3 as shown in FIG. 3. When the slider 3 is pulled upward after the insertion, the joining piece 10 and the fitting piece 11 swing in a direction that they approach each other as shown in FIG. 4, so that the right and left fastener stringers 1 are brought near each other. Consequently, the insertion portion 30 is fit into the insertion concave groove 15 of the holding portion 13 so that the fastener elements 8 couple with each other thereby closing the fastener.

When the insertion portion 30 of the fitting piece 11 is fit into the insertion concave groove 15 of the holding portion 13 provided on the joining piece 10, a side end of the insertion portion 30 presses the guide post 6 of the slider 3 located in the notch portion 14 of the holding portion 13, so that the guide post 6 is moved slightly upward of the notch portion 14. Consequently, the starting operation of the slider 3 is facilitated.

When the right and left fastener stringers 1 are closed, as shown in FIGS. 4 and 6, the convex portion 37 of the fitting piece 11 fits into the concave portion 27 of the joining piece 10 and the convex portion 23 of the joining piece 10 fits into the concave portion 40 of the fitting piece 11. Thus, even when a pushing-up force is applied from the front or rear side of the bottom end stop, the engagement is never released.

To release the closed fastener stringer 1, the slider 3 is pulled down and brought through the holding portion 13. With this slider 3 in contact with the base portion 17 of the joining piece 10 and the base portion 31 of the fitting piece 11, the fitting piece 11 is rotated in a releasing direction. As a result, the insertion portion 30 of the fitting piece 11 is released from the slider 3 so that the convex portions 23 and 37 come out of the concave portions 40, 27. When the joining piece 10 and the fitting piece 11 are pulled in a separating direction, that is, in a vertical direction with respect to the front and back surfaces of the fastener tape 2, the engagement between the male engaging portion 20 and the female engaging portion 34 is released, so that the right and left fastener stringers 1 can be separated.

Figure 7:
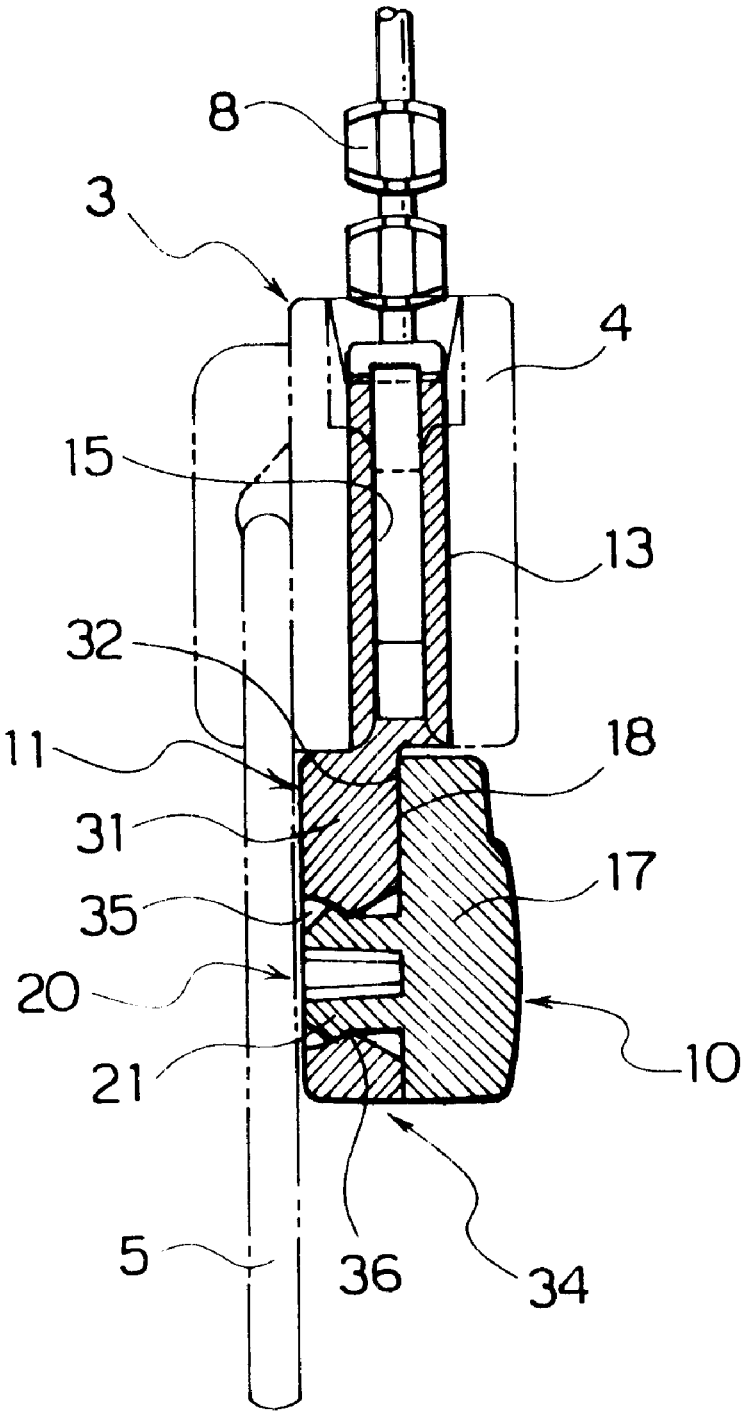
FIG. 7 is a sectional view corresponding to FIG. 5 showing a modification of the first embodiment.

A bottom end stop shown in FIG. 7 is a modification of the first embodiment. The holding portion 13 is provided on the fitting piece 11 having the female engaging portion 34 and the slider 3 is fit and held in this holding portion 13. In this case, a hole portion 35 of the female engaging portion 34 appears on the surface of the bottom end stop. The male engaging portion 20 of the joining piece 10 is fit from the rear side of the bottom end stop so that it engages. Therefore, the pull tab 5 of the slider 3 covers the surface of the hole portion 35. The pull tab 5 exists on an opposite side to a surface in which the inner surface 18 of the joining piece 10 faces the inner surface 32 of the fitting piece 11, with the base portion 31 of the fitting piece 11 in between. Therefore, there is no trouble in the engagement operation between the female engaging portion 34 and the male engaging portion 20.

Figure 8:
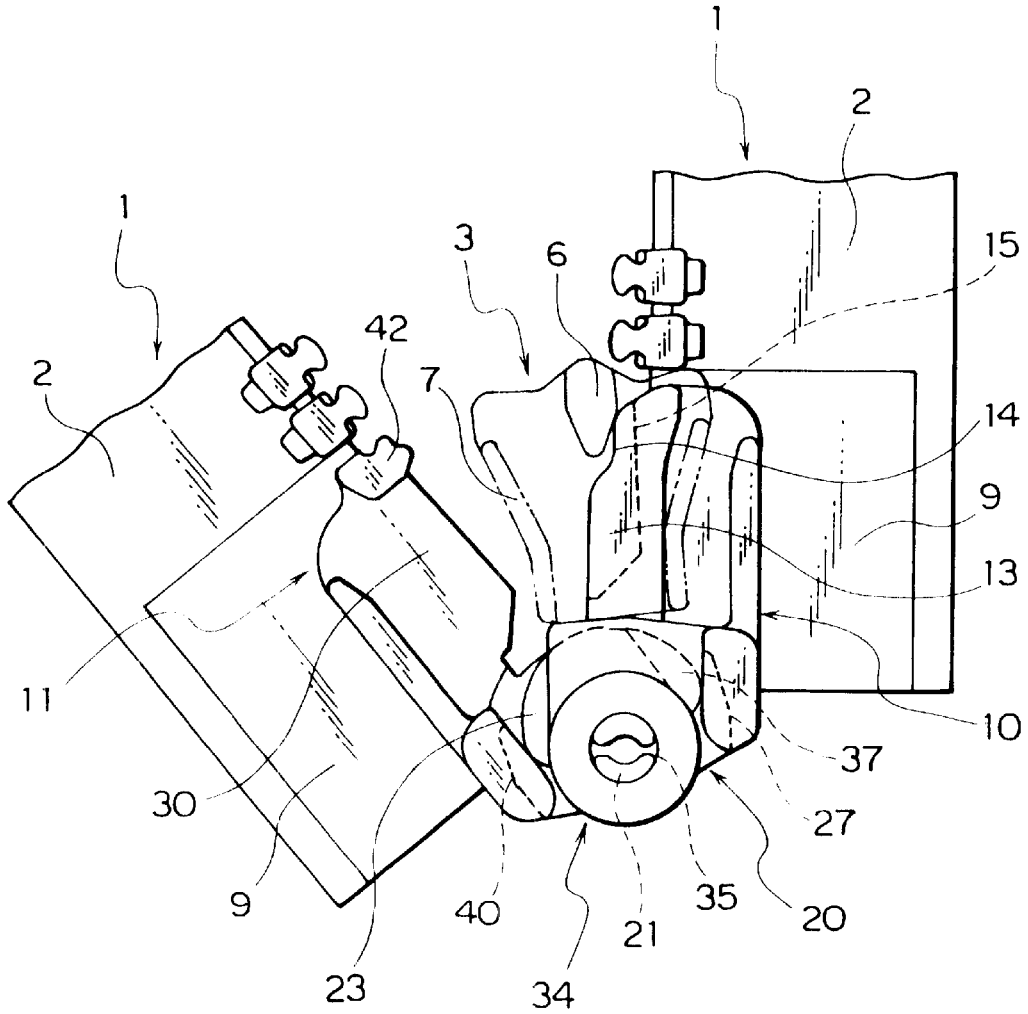
FIG. 8 is a front view corresponding to FIG. 2 showing other modification of the first embodiment.

A bottom end stop shown in FIG. 8 is also a modification of the first embodiment. According to the first embodiment, the slider 3 is fit and held in the left fastener stringer 1 as shown in FIG. 2. In this modification, all the configurations are arranged inversely to fit and hold the slider 3 in the right fastener stringer 1.

Figure 9:
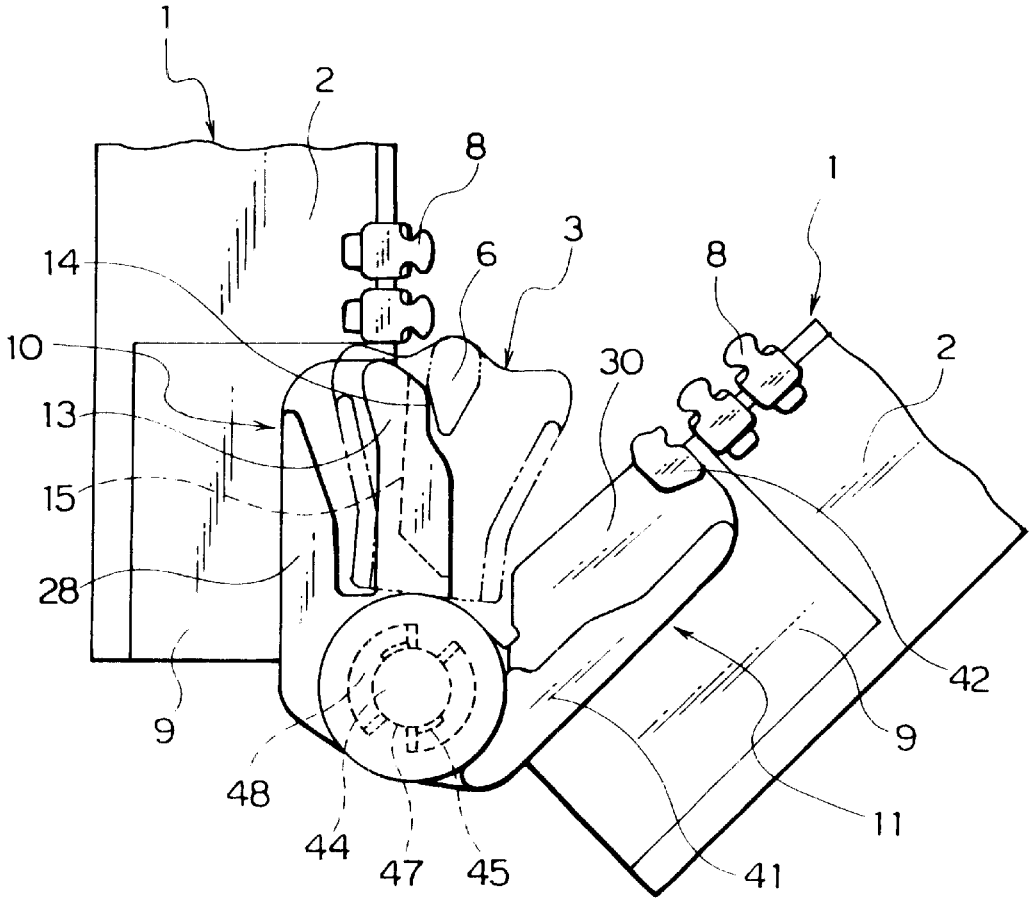
FIG. 9 is a front view showing a state of engagement between the joining piece and the fitting piece of the bottom end stop according to second embodiment.

In the bottom end stop according to the second embodiment shown in FIGS. 9 to 17, the joining piece 10 is attached to a bottom end of one fastener stringer 1 and the fitting piece 11 is attached to a bottom end of the other fastener stringer 1 as shown in FIG. 9. The joining piece 10 and the fitting piece 11 are formed by integral molding using thermoplastic resin on the reinforcement tape 9 which reinforces an end portion of the fastener tape 2.

Figure 11:
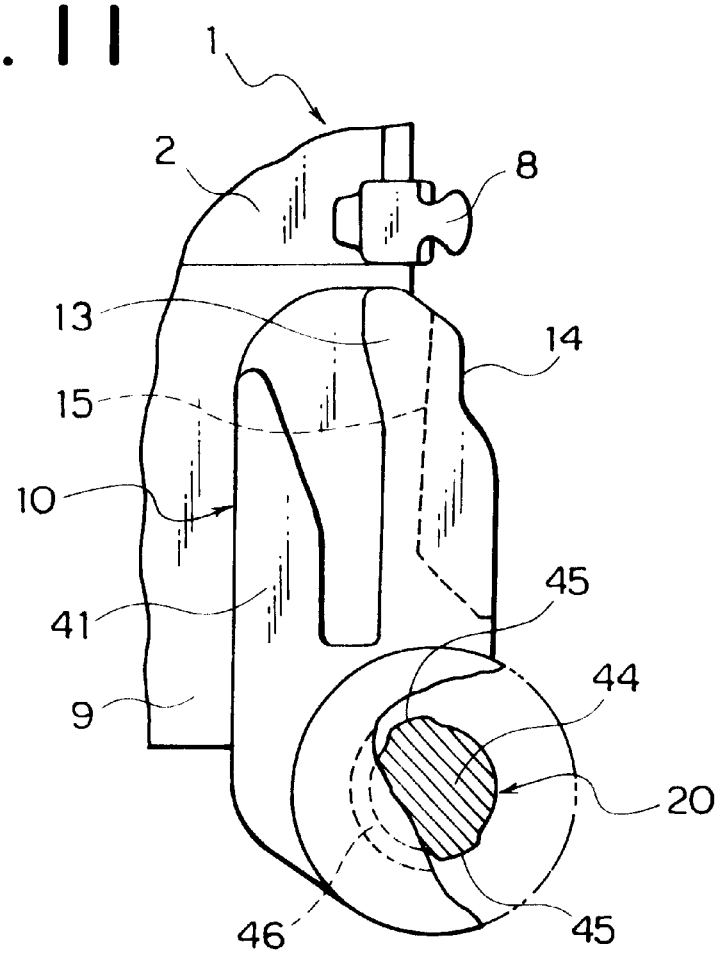
FIG. 11 is a partially broken front view of the joining piece of the bottom end stop.
Figure 12:
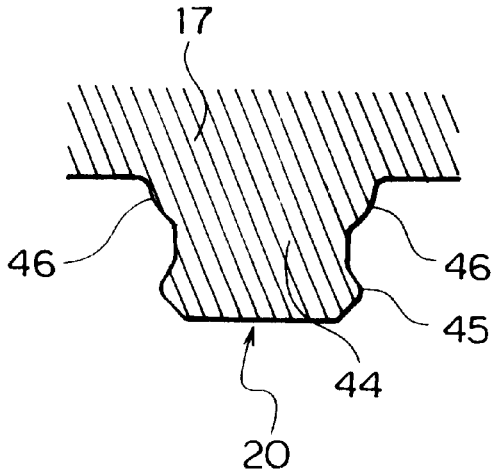
FIG. 12 is a longitudinal sectional view of a protrusion of the joining piece of the bottom end stop.

In the joining piece 10, as shown in FIG. 11, there is provided the holding portion 13, which is continuous with the fastener elements 8, attached to the fastener tape 2 for inserting and holding the slider 3. An inner side edge of this holding portion 13 is formed in a V shape for guiding the guide flange 7 of the slider 3. Further, the notch portion 14 which is inclined gently and relatively smaller than an outside shape of the guide post 6 of the slider 3 is provided on a top portion of the outer side edge so that the guide post 6 can inserted into this notch portion 14. The insertion concave groove 15 is formed in a side face of the outer side edge of the holding portion 13 and the insertion portion 30 of the fitting piece 11 can be fit therein.

The base portion 17 having a thickness substantially half the thickness of the body 4 of the slider 3 is provided at an end of the holding portion 13. A cylindrical protrusion 44 is provided in the center of this base portion 17 such that it protrudes to the rear side thereof. A head portion 45 protruding outward is provided so as to oppose diagonally with respect to the longitudinal direction of the fastener stringer 1 on part of an end of this protrusion 44 as shown in FIG. 11. Further, a thick portion 46 expanding outward is provided on a periphery of a base portion of the protrusion 44, so that when the male engaging portion 20 fits into the hole portion 35 of the female engaging portion 34, it comes into contact with the periphery of the hole portion 35. Further, a reinforcement rib 41 parallel to the holding portion 13 is formed from the base portion 17 on an inner side edge of the joining piece 10, that is, on an opposite side to the outer side edge in which the holding portion 13 is formed.

Figure 13:
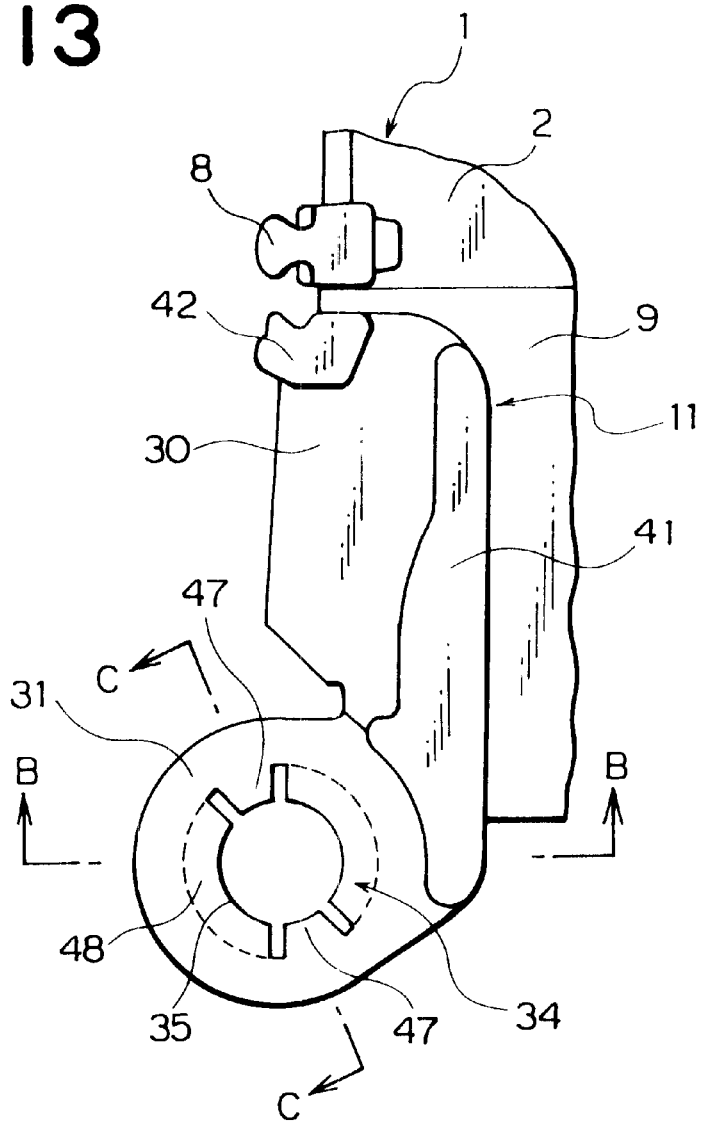
FIG. 13 is a front view of the fitting piece of the bottom end stop.

The fitting piece 11 attached to the bottom end of the other fastener stringer 1 is provided with the coupling portion 22. 42 adjacent the fastener element 8, whose one surface has the same shape as the fastener element 8 as shown in FIG. 13. The thin, flat shaped insertion portion 30 is provided from this coupling portion 42 to an end portion and this insertion portion 30 is fit in the insertion concave groove 15 formed in the holding portion 13.

Figure 14:
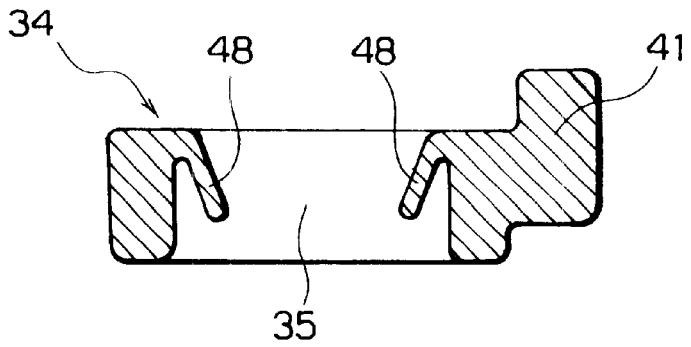
FIG. 14 is a sectional view taken along the line B—B of FIG. 13 of the bottom end stop.
Figure 15:
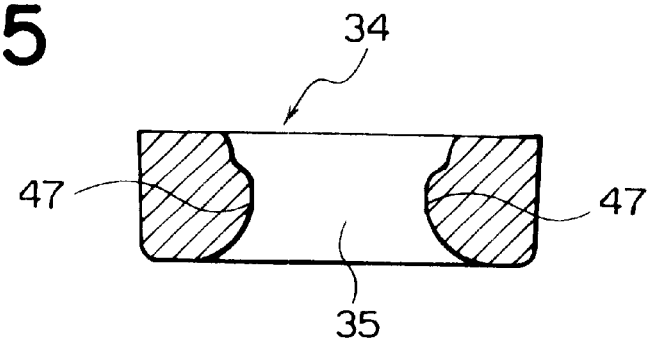
FIG. 15 is a sectional view taken along the line C—C of FIG. 13 of the bottom end stop.
Figure 16:
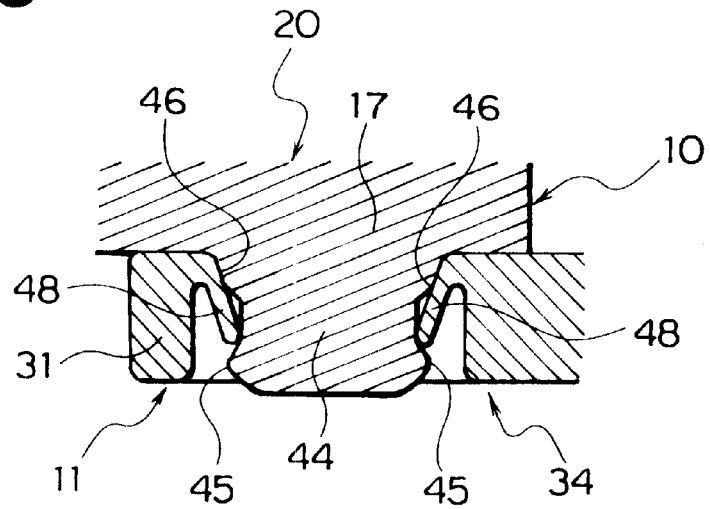
FIG. 16 is a sectional view of essential portions showing a state of engagement between a head portion of the protrusion and an elastic piece of the bottom end stop.
Figure 17:
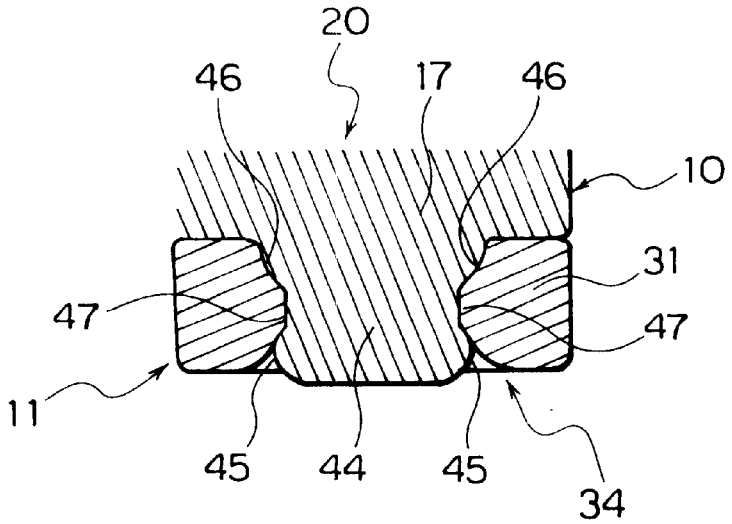
FIG. 17 is a sectional view of essential portions when the head portions of the protrusion overlie the protrusion in the bottom end stop.
Figure 18:
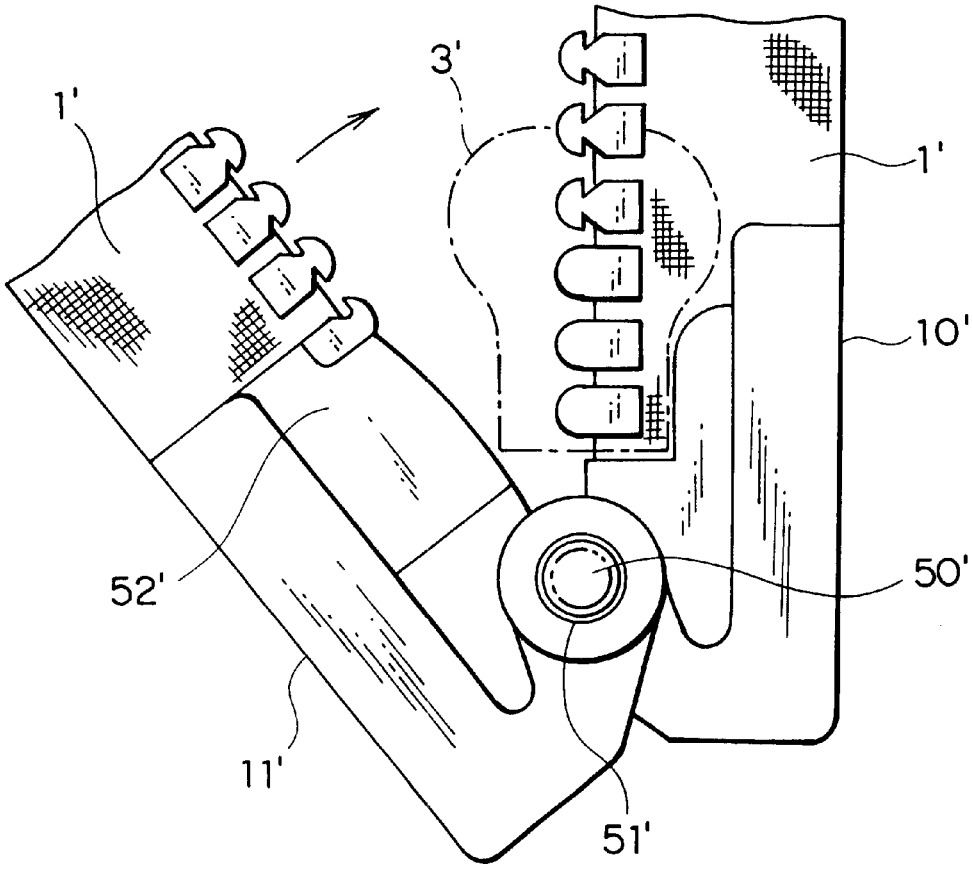
FIG. 18 PRIOR ART
FIG. 18 is a front view showing a state of engagement between a joining piece and a fitting piece of a known bottom end stop.

The circular base portion 31 having substantially the same thickness as the base portion 17 of the joining piece 10 is provided continuously at an end of the insertion portion 30. The hole portion 35 in which the protrusion 44 of the male engaging portion 20 fits into is provided at a center of the base portion 31. This hole portion 35 has protruding portions 47 at positions corresponding to the head portions 45 protruded from the protrusion 44 as shown in FIG. 15. Tongue-like elastic pieces 48 projecting downward from the surface of the base portion 31 are provided at positions other than the protruding portions 47 as shown in FIG. 14. Further, the reinforcement rib 41 is provided on an inner side edge of the fitting piece 11 from the base portion 31, that is, along an opposite side to the outer side edge in which the insertion portion 30 is formed, thereby reinforcing the fitting piece 11.

An operation of the bottom end stop of the second embodiment will be described. First, as shown in FIG. 9, the joining piece 10 and the fitting piece 11 mounted on the right and left fastener stringers 1 are engaged by a snap method by bringing the male engaging portion 20 and the female engaging portion 34 into contact with each other and pressing them. Upon this engagement, the head portion 45 of the protrusion 44 presses the elastic piece 48 of the hole portion 35 so that the head portion 45 is fit and engaged.

Since the thick portion 46 comes into contact with the periphery of the inside of the hole portion 35 at this time, even when a lateral pulling force is applied in the right and left direction which is perpendicular to a longitudinal direction of the fastener stringer 1, it never happens that the protrusion 44 moves within the hole portion 35 and presses the elastic piece 48 in an engagement state so that the elastic piece 48 is deformed to approach the inner face of the hole portion. Thus, the engagement between the male engaging portion 20 and the female engaging portion 34 is never released.

Figure 10:
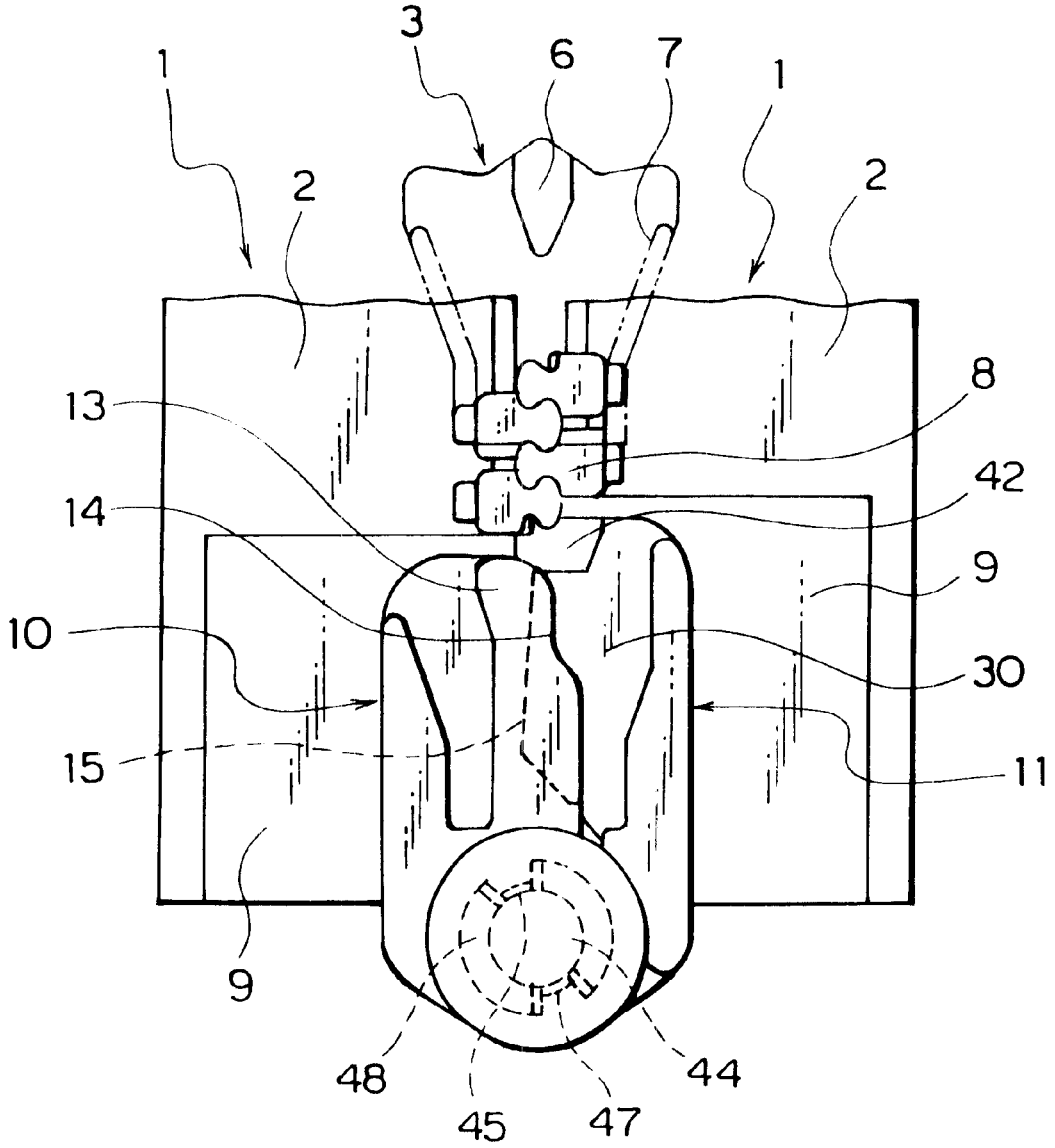
FIG. 10 is a front view showing the bottom end stop when the joining piece and the fitting piece are joined together and the slider is started.

After the male engaging portion 20 is engaged with the female engaging portion 34, the insertion portion 30 of the fitting piece 11 is inserted into the slider 3 between the guide flanges 7 of the slider 3. When the slider 3 is pulled upward after the insertion, the joining piece 10 and fitting piece 11 swing in a direction that they approach each other as shown in FIG. 10. As a result, the right and left fastener stringers 1 are brought near each other. Then, the insertion portion 30 is inserted into the insertion concave groove 15 of the holding portion 13 and the fastener elements 8 couples with each other thereby closing the fastener. When the bottom end stop is closed, the head portion 45 formed on the protrusion 44 of the male engaging portion 20 lies over vertically on the protruding portion 47 formed in the hole portion 35 of the female engaging portion 34 thereby maintaining the engagement state firmly. Thus, even when a pushing-up force is applied to the bottom end stop from the front or rear surface, the engagement is never released.

To release the closed fastener stringer 1, similar to the first embodiment, the slider 3 is pulled down and inserted into the holding portion 13 with the slider 3 in contact with the base portion 17 of the joining piece 10 and the base portion 31 of the fitting piece 11. Then, when the fitting piece 11 is rotated in a releasing direction, the insertion portion 30 of the fitting piece 11 is released from the slider 3. As a result, the lie-over between the head portion 45 and the protruding portion 47 is released. When the joining piece 10 and the fitting piece 11 are pulled in a separating direction, that is, in a vertical direction with respect to the front and rear surfaces of the fastener tape 2, the engagement between the male engaging portion 20 and the female engaging portion 34 is released. Consequently, the right and left fastener stringers 1 can be separated from each other.

Also in this bottom end stop, when the insertion portion 30 of the fitting piece 11 is fit in the insertion concave groove 15 of the holding portion 13 provided on the joining piece 10, the guide post 6 of the slider 3 located within the notch portion 14 of the holding portion 13 is pressed diagonally from below by a side end of the insertion portion 30. As a result, the guide post 6 is moved slightly upward of the notch portion 14 so that the starting operation of the slider 3 is facilitated.

The bottom end stop for the slide fastener of the present invention has such a feature and exhibits the following effects.

In the bottom end stop for a slide fastener according to the first aspect, a fitting piece 11 is attached to a bottom end of one of right and left fastener stringers 1, while a joining piece 10 is attached to the bottom end of the other fastener stringer 1. A female engaging portion 34 and a male engaging portion 20 are formed on the fitting piece 11 and the joining piece 10 respectively, such that they can be engaged with/disengaged from each other in a vertical direction with respect to faces of respective fastener tapes 2 and so that the female engaging portion 34 and the male engaging portion 20 are rotatable freely in a horizontal direction when they are engaged. A holding portion 13 is provided on an opposing edge portion of the fastener stringer 1 of the joining piece 10 or the fitting piece 11 to prevent an escape of the slider 3. The joining piece 10 or the fitting piece 11 in which the slider 3 is fit and held in a holding portion 13 thereof faces the fitting piece 11 or the joining piece 10 on an opposite surface to a side in which a single pull tab 5 of the slider 3 exists, so that the male engaging portion 20 and the female engaging portion 34 can engage each other. Therefore, when the female engaging portion 34 is engaged with the male engaging portion 20, the pull tab 5 of the slider 3 never obstructs an engagement operation. Therefore this bottom end stop can be operated easily and quickly.

The male engaging portion 20 has leg portions 21 each having an outer face curved in an arc-shape and elastically deformable, and head portions 22 at front ends of the leg portions 21 and expanding outward. The leg portions 21 is erected in a vertical direction with respect to faces of fastener tapes 2 while facing in a longitudinal direction in form of a pair of protruding pieces. The female engaging portion 34 has a circular hole portion 35 penetrated therein which the leg portions 21 are capable of passing through in a vertical direction with respect to faces of the fastener tapes 2 and locking portions 36 which are protruded into the inner face of the hole portion 35 so that they are capable of locking with the head portions 22. Therefore, the pair of the leg portions 21 is elastically deformed only on a side which they face each other, that is, in a longitudinal direction of the fastener tape 2. As a result, even when a lateral pulling force is applied, the leg portions 21 are not deformed, so that a strong engagement can be achieved.

The male engaging portion 20 has a thick portion 46 expanding around a periphery of a base portion 17 thereof and head portions 45 provided at a front end thereof so as to expand outward, and a protrusion 44 erected vertically with respect to faces of the fastener tapes 2. The female engaging portion 34 has a circular hole portion 35 which is provided in a vertical direction with respect to the faces of the fastener tapes 2 which is capable of inserting the protrusion 44 and elastic pieces 48 extending downward into the inner face of the hole portion 35 and which are capable of engaging the head portion 45. When the head portions 45 engage with the elastic pieces 48, the thick portion 46 is capable of coming into contact with an inner peripheral surface of the hole portion 35. Therefore, because the thick portion 46 is in contact with the periphery of the hole portion 35, even if a lateral pulling force is applied, the protrusion 44 does not press and deform the elastic piece 48 so that a strong engagement can be achieved.

The protrusion 44 has head portions 45 expanding to both sides so that they oppose each other and an inner face of the hole portion 35 has protruding portions 47 which are provided so as to oppose each other and protrude inward and lies over the head portions 45 in a vertical direction with respect to the faces of the fastener tapes 2 when the fitting piece 11 and the joining piece 10 are rotated in a direction that they are joined together. Therefore, even when a pushing-up force is applied to the bottom end stop from the front or rear surface thereof, the engagement is never released because the head portions 45 lie over the protruding portions 47.

The fitting piece 11 and the joining piece 10 have convex portions 23,37 expanding in a horizontal direction with respect to faces of fastener tapes 2 and concave portions 27,40 in which the convex portions 23,37 are capable of fitting into, when the fitting piece 11 and the joining piece 10 are rotated in a direction that they are joined together. Therefore, even when a pushing-up force is applied to the bottom end stop from the front or rear surface thereof, the engagement is never released because the convex portions 23,37 fit in the concave portions 27,40.

The concave portions 27,40 comprise inner surfaces 18,32 of the base portions 17,31 on a side in which the fitting piece 11 and the joining piece 10 lie over each other, vertical walls 25,38 erected from the base portions 17,31 in a vertical direction with respect to the faces of fastener tapes 2, and horizontal plates 26,39 provided at each end of the vertical walls 25,38 and extending in parallel to the inner surfaces 18,32 of the base portions 17,31. The horizontal plates 26,39 restrict a path of insertion of the convex portions 23,37 into the concave portions 27, 40 when the fitting piece 11 engages the joining piece 10, thereby specifying an engagement position in the horizontal direction of the fitting piece 11 and joining piece 10. Therefore, when the joining piece 10 is engaged with the fitting piece 11, a contact between the slider 3 and insertion portion 30 can be avoided without visual checking, so that the engagement operation can be achieved easily without any trouble.

A notch portion 14 which is inclined gently and is capable of inserting a guide post 6 of the slider 3 is provided at a top portion of an outer side edge of the holding portion 13 formed on one of the fitting piece 11 and the joining piece 10, and an insertion concave groove 15 is provided in a side edge face of the holding portion 13 while an insertion portion 30 capable of fitting into the insertion concave groove 15 is provided on the other one of the fitting piece 11 and the joining piece 10, so that when the insertion portion 30 is fit into the insertion concave groove 15, the slider 3 held in the holding portion 13 is capable of moving slightly upward. Therefore, the slider 3 can be started smoothly, securely and easily.

The female engaging portion 34 and male engaging portion 20 disposed on the fitting piece 11 and joining piece 10 attached to a bottom end of the fastener tape 2 are located outside of the bottom end of the fastener tape 2. Therefore, the rotation of the right and left fastener stringers 1 can be achieved smoothly and easily. Further, the female engaging portion 34 and male engaging portion 20 can be molded in a rigid structure. Accordingly, there are remarkable effects obtained by this invention.

What is claimed is:

1. A bottom end stop for a slide fastener, comprising:

a fitting piece attached to a bottom end of a first fastener stringer;

a joining piece attached to a bottom end of a second fastener stringer; and a female engaging portion and a male engaging portion formed on said fitting piece and said joining piece, respectively, such that they can be engaged with or disengaged from each other in a vertical direction with respect to faces of the respective fastener stringers and said female engaging portion and said male engaging portion are rotatable freely in a horizontal direction when they engage each other, wherein said male engaging portion has a pair of leg portions and head portions, wherein each of the leg portions has an outer face curved in an arc-shape and is elastically deformable and the head portions are provided at front ends of the leg portions and expand outward, said leg portions erected in a vertical direction with respect to the faces of the fastener stringers while facing in a longitudinal direction in form of a pair of protruding pieces; and wherein said female engaging portion has a circular hole portion and a locking portion, wherein the circular hole portion is capable of receiving said leg portions in a vertical direction with respect to the faces of the fastener stringers and the locking portion is formed around the center of an inner face of the hole portion such that it protrudes inward and locks the head portions of the male engaging portion when the male and female engaging portions are engaged.

2. A bottom end stop for a slide fastener, comprising:

a fitting piece attached to a bottom end of a first fastener stringer;

a joining piece attached to a bottom end of a second fastener stringer; and a female engaging portion and a male engaging portion formed on said fitting piece and said joining piece, respectively, such that they can be engaged with or disengaged from each other in a vertical direction with respect to faces of the respective fastener stringers and said female engaging portion and said male engaging portion are rotatable freely in a horizontal direction when they engage each other, wherein said male engaging portion has a protrusion that protrudes vertically to the bottom end stop with respect to the faces of the fastener stringers and head portions provided at an end of the protrusion which protrude outward; and wherein said female engaging portion has a circular hole portion and elastic pieces wherein the circular hole is provided in a vertical direction with respect to the faces of the fastener stringers and is capable of fitting the protrusion of the male engaging portion and the elastic pieces project downward into an inner face of the hole portion and are capable of engaging the head portion.

3. A bottom end stop for a slide fastener according to claim 2, wherein said protrusion has head portions expanding to both sides so that they oppose each other and an inner face of said hole portion has protruding portions which are provided so as to oppose each other, protrude inward and lie over the head portions in a vertical direction with respect to the faces of the fastener tapes when the fitting piece and the joining piece are rotated in a direction that they are joined together.

4. A bottom end stop for a slide fastener according to claim 2, wherein:

said male engaging portion has a thick portion expanding outward around a periphery of a base portion of the protrusion; and the thick portion is capable of coming into contact with an inner peripheral face of the hole portion when the head portions of the male engaging portion engage the elastic pieces of the female engaging portion.

5. A bottom end stop for a slide fastener, comprising:

a fitting piece attached to a bottom end of a first fastener stringer;

a joining piece attached to a bottom end of a second fastener stringer; and a female engaging portion and a male engaging portion formed on said fitting piece and said joining piece, respectively, such that they can be engaged with or disengaged from each other in a vertical direction with respect to faces of the respective fastener stringers and said female engaging portion and said male engaging portion are rotatable freely in a horizontal direction when they engage each other, wherein the fitting piece has a concave portion and a convex portion and the joining piece has a concave portion and a convex portion wherein each convex portion expands in a horizontal direction with respect to the faces of the fastener stringers and wherein the convex portion of the fitting piece is capable of fitting into the concave portion of the joining piece and the convex portion of the joining piece is capable of fitting into the concave portion of the fitting piece when the fitting piece and the joining piece are rotated in a direction that they are joined together.

6. A bottom end stop for a slide fastener according to claim 5, wherein:

the concave portion of the joining piece comprises an inner surface of a base portion of the joining piece on a side in which the fitting piece and the joining piece lie over each other, a vertical wall erected on the base portion of the joining piece and extending in a vertical direction with respect to the faces of fastener stringers, and a horizontal plate provided at an end of the vertical wall and extending in parallel to the inner surface of the base portion of the joining piece;

the concave portion of the fitting piece comprises an inner surface of a base portion of the fitting piece on a side in which the fitting piece and the joining piece lie over each other, a vertical wall erected on the base portion of the fitting piece and extending in a vertical direction with respect to the faces of fastener stringers, and a horizontal plate provided at an end of the vertical wall and extending in parallel to the inner surface of the base portion of the fitting piece; and the horizontal plates restrict a path of insertion of the convex portions into the concave portions when the fitting piece engages the joining piece, thereby specifying an engagement position in the horizontal direction of the fitting piece and joining piece.

7. A bottom end stop for a slide fastener according to claim 1, 2, or 5, further comprising:

a holding portion formed on one of the fitting piece or the joining piece and includes a notch portion and an insertion concave groove wherein the notch portion, which is inclined gently and is capable of inserting a guide post of the slider, is provided at a top portion of an outer side edge of the holding portion and the insertion concave groove is provided on a side edge face of the holding portion, wherein the other one of the fitting piece and the joining piece in which the holding portion is not included comprises a flat insertion portion capable of fitting into the insertion concave groove, so that when the flat insertion portion is fit into the insertion concave groove, the slider held by the holding portion is capable of moving slightly upward.

8. A bottom end stop for a slide fastener according to claim 1, 2, or 5, wherein the female engaging portion and male engaging portion disposed on the fitting piece and the joining piece, respectively, attached to bottom ends of the fastener stringers are located outside of the bottom end of the fastener stringers.

* * * * *